United States Patent [19]

Rushing

[11] Patent Number: 4,607,944

[45] Date of Patent: Aug. 26, 1986

[54] APPARATUS FOR CONTROLLING TONER REPLENISHMENT IN ELECTROGRAPHIC COPIER

[75] Inventor: Allen J. Rushing, Webster, N.Y.

[73] Assignee: Eastman Kodak Company, Rochester, N.Y.

[21] Appl. No.: 742,357

[22] Filed: Jun. 7, 1985

[51] Int. Cl.[4] ..... G03G 15/08

[52] U.S. Cl. ..... 355/14 D; 355/3 DD; 118/688; 118/691

[58] Field of Search ..... 355/3 DD, 14 D, 3 R, 355/14 R, 8; 118/653, 688, 691

[56] References Cited

U.S. PATENT DOCUMENTS

| | | | |
|---|---|---|---|
| 3,635,555 | 1/1972 | Kurahashi et al. | 355/8 |
| 3,674,353 | 7/1972 | Trachtenberg | 355/3 DD |
| 3,779,203 | 12/1973 | Altmann | 118/8 |
| 3,815,988 | 6/1974 | McVeigh et al. | 355/3 R |
| 3,910,459 | 10/1975 | Bock et al. | 222/56 |
| 3,924,462 | 12/1975 | Bock | 355/3 DD X |
| 4,372,672 | 2/1983 | Pries | 355/14 R |
| 4,377,338 | 3/1983 | Ernst | 355/14 D |
| 4,385,823 | 5/1983 | Kasper et al. | 355/3 R |
| 4,431,300 | 2/1984 | Snelling | 355/14 D |

*Primary Examiner*—A. C. Prescott

*Attorney, Agent, or Firm*—Warren W. Kurz

[57] ABSTRACT

Apparatus for controlling the replenishment of toner in an electrographic reproduction apparatus includes means for monitoring toner concentration in an electrographic developer mix, and means for monitoring the rate of toner depletion from such mix in developing electrostatic images. The outputs of such monitoring means are algebraically summed to provide a control signal for controlling toner replenishment.

4 Claims, 7 Drawing Figures

APPARATUS FOR CONTROLLING TONER REPLENISHMENT IN ELECTROGRAPHIC COPIER

BACKGROUND OF THE INVENTION

1. Field of the Invention

This invention relates to the field of electrography and, more particularly, to improvements in apparatus for controlling toner replenishment.

2. Description of Prior Art

In electrography, electrostatic images formed on a dielectric recording element are rendered visible via the application of pigmented, thermoplastic particles known as toner. Typically, such toner forms part of a two-component developer mix consisting of the toner particles and relatively larger magnetically-attractible carrier particles to which the toner particles adhere via triboelectric forces. During the development process, the electrostatic forces associated with the latent image act to strip the toner particles from their associated carrier particles, and the partially denuded carrier particles are returned to a reservoir to be replenished with toner.

It is well known in the art to continuously monitor the toner concentration in an electrographic developer mix and to replenish the mixture with toner when the concentration thereof falls below a predetermined level. Such a toner concentration monitor can be easily calibrated to compensate for toner depletion from the development system regardless of cause. Its only significant drawback is that it is relatively slow to respond to abrupt changes in toner depletion rate, such as occasioned by a change in the original documents being copied from ones having little image information thereon, to ones having large solid or continuous tone image areas. Typically, several minutes will elapse before the toner concentration is restored to a level at which copies of a desired image density can be obtained.

It is also known in the art to continuously monitor toner depletion from an electrographic development station by monitoring the amount of toner applied to the recording element during development. For example, in the commonly assigned U.S. Pat. No. 3,674,353 issued to Trachtenberg, a pair of induction plates, positioned adjacent the recording element on the upstream and downstream sides of the development station, function to sense the overall charge on the recording element before and after development. The difference in charge induced on the plates by the passage of the undeveloped and developed charge patterns has been found to be an accurate measure of the quantity of toner depleted from the development station. A toner depletion signal, proportional to the difference in charge induced on the induction plates, is used to control toner replenishment. While such toner depletion monitors are quick to respond to abrupt changes in toner depletion rate, their use for controlling toner replenishment has certain disadvantages. For example, any toner depletion aside from that caused by image development (e.g. dusting and other losses) is not sensed by such a monitor and, hence, cannot be accounted for by replenishment. Nor can such a monitor detect and cure inaccuracies or defects in the toner replenishment process. In short, toner depletion monitors are difficult, at best, to calibrate to achieve precise control of toner replenishment.

SUMMARY OF THE INVENTION

In view of the foregoing discussion, an object of this invention is to provide a toner replenishment control apparatus which overcomes the aforementioned disadvantages of prior art systems. The toner replenishment control apparatus of the invention comprises both a toner depletion monitor and a toner concentration monitor, and means for algebraically summing the respective output signals of such monitors to produce a control signal for controlling toner replenishment. Combining the respective outputs of such monitors to control toner replenishment has the unexpected technical effect of combining the respective advantages of such monitors while overcoming the respective disadvantages. The result is a readily calibratable toner control apparatus having a relatively fast response time.

The invention and its various advantages will become more apparent to those skilled in the art from the ensuing detailed description of preferred embodiments, reference being made to the accompanying drawings.

DETAILED DESCRIPTION OF PREFERRED EMBODIMENTS

Figure 1:
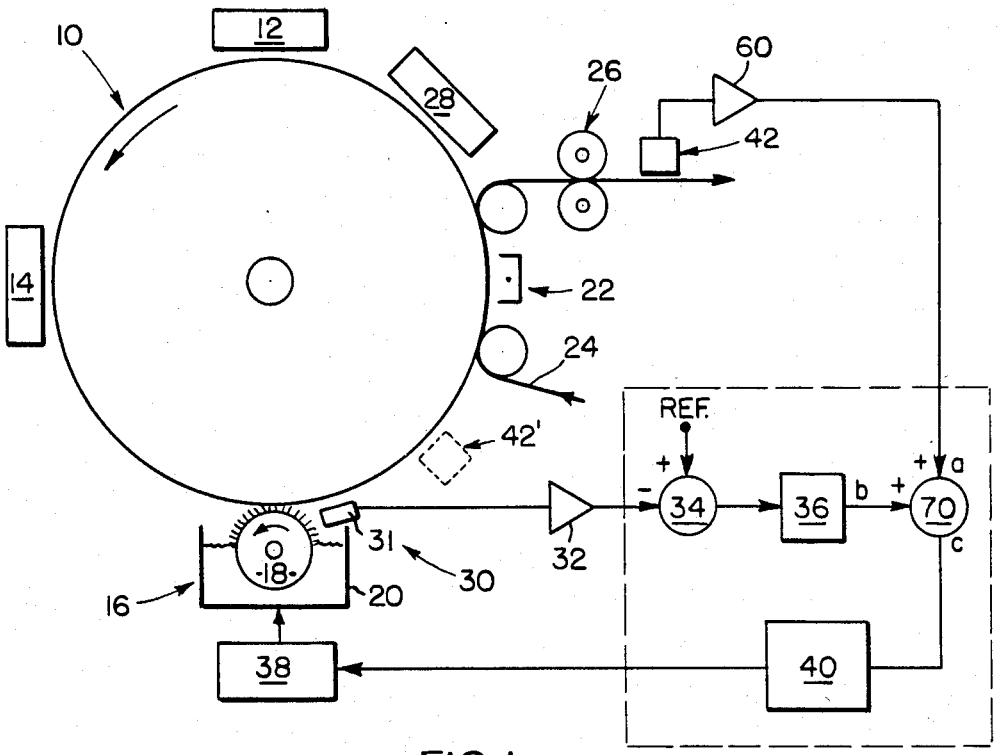
FIG. 1 is a schematic illustration of an electrophotographic document copier embodying the invention.

Referring now to the drawings, FIG. 1 schematically illustrates an electrophotographic copying apparatus comprising a photoconductive recording element 10 which moves in an endless path in the direction of the arrow. As the recording element advances, it receives a uniform electrostatic charge at charging station 12. This uniform charge is selectively dissipated by an imagewise exposure, at exposure station 14, to the light and dark patterns constituting a document being copied. The resulting latent electrostatic image then passes a development station 16 which may, for example, comprise a conventional magnetic brush applicator 18 which rotates in a sump 20 containing a two-component electrographic developer comprising magnetic carrier particles and toner. As applicator 18 rotates, it advances the developer mixture into contact with the latent image-bearing recording element. The electrostatic forces associated with the image being developed act to strip the toner particles from the carrier particles to which they adhere by triboelectric forces and apply them to the electrostatic image to render it visible. The resulting toner image then advances to a transfer station 22 at which the toner particles are attracted to an image receiving member 24 to which it is fused at a fusing station 26. Thereafter, residual toner is removed from the recording element at a cleaning station 28 and the cycle is repeated.

Changes in the concentration of toner particles in the developer mix are monitored by a conventional toner concentration monitor 30 which may comprise, for example, a photoelectric device 31 which acts to irradiate the developer mix carried by the magnetic brush applicator and sense the reflectivity thereof. The reflectivity of the developer mix, of course, is inversely proportional to toner concentration. The output of photoelectric device 31, upon being suitably amplified by amplifier 32, is fed to a comparator 34 which compares the amplified output with a reference signal representing a desired toner concentration level. The output of comparator 34 may be fed to a standard proportional and integral (PI) controller 36 which produces an output signal having a component proportional to its input and a component proportional to the integral thereof. The integral term assures that there will be a zero steady-state error for any constant rate of toner depletion. The output of the PI controller is used to drive a toner replenishment motor 38 (used to introduce additional toner to the development station) via a motor controller 40. In the past, the output of the toner concentration monitor was the sole feedback signal for controlling toner replenishment. As mentioned above, the primary disadvantage of this toner replenishment approach is one of slow response time to sudden changes in toner depletion rate.

According to the invention, the output signal from the toner concentration monitor 30 is augmented by the output of a toner depletion monitor 42 which, as described below, functions to provide a signal approximately proportional to the instantaneous rate of toner image depleted from the development station 16 during image development. Toner depletion monitor 42 may be positioned at any point along the path traveled by the toner image, either before or after transfer to the receiving member 24. Preferably, monitor 42 is designed to optically monitor the overall reflectivity of the toner image. In the event the receiver member's reflectivity is greater than that of the recording element, monitor 42 is preferably positioned along the receiver member path, as shown in FIG. 1. Alternatively, however, the depletion monitor may be positioned adjacent the path of the recording element between the development station 16 and transfer station 22, as shown in the phantom lines of 42'. Yet another alternative configuration for the depletion monitor would be to sense the overall transmittance (rather than reflectivity) of the toned image, either on the recording element or the receiver member.

Figure 2:
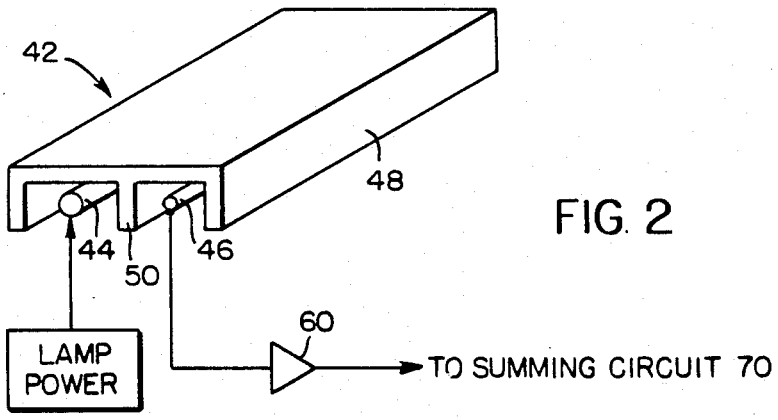
FIG. 2 is a perspective view of a preferred apparatus for optically monitoring toner depletion.

Referring to FIG. 2, toner depletion monitor 42 preferably comprises an elongated fluorescent lamp 44 for illuminating the toner image, and a single elongated photodiode 46, such as United Detector Technology Inc. Model No. PIN-L9. The fluorescent lamp and photodiode are housed in a common housing 48. A baffle 50 is provided between the lamp and the photodiode to assure that the photodiode is illuminated by radiation reflected from the toner image passing opposite the open side of the housing. As an alternative to an elongated photodiode detector, a linear fiber optic array may be positioned across the path of the toner image to collect light reflected from the toner image and direct such light to the input of a photomultiplier tube or the like. As another alternative, an internally reflecting glass rod with a collection slit in the reflecting coating and a spot-detector at one end could be used to collect, integrate and detect the reflected light from the toner image.

Referring again to FIG. 1, the output of the depletion monitor 42 is amplified by a conventional amplifier 60, and the amplified output is fed to a summing circuit 70 which algebraically sums the toner depletion signal with the output signal provided by the toner concentration monitor 30. From a process control point of view, the system shown in FIG. 1 may be considered as PI control with feedforward of load (toner depletion ) disturbance. The output of summing circuit 70 is fed to motor controller 40 which controls, for example, the duty cycle of a control signal supplied to toner replenisher motor 38. While circuit elements 34, 36, 40 and 70 may comprise discrete circuits, the function of these circuits can be be implemented by a Texas Instruments Inc. PM-550 programmable controller. The PM-550 has analog-to-digital converters to receive the concentration and use-up monitor signals, and a 120 VAC output module to drive the replenisher motor 38. Since the sampled toner concentration monitor signal may be relatively noisy, it is preferable to subject the output of amplifier 32 to a first-order low-pass filter with a time constant of approximately 5 seconds.

The toner replenishment control apparatus of the invention has been demonstrated to provide more accurate toner replenishment than that provided by a toner depletion monitor acting alone. Moreover, such apparatus is much quicker to respond to changes in toner depletion than a conventional toner concentration monitor acting alone, and allows the use of smaller developer sumps. The advantageous technical effect of the apparatus of the invention is that toner replenishment is initiated by the depletion monitor component long before the results of an abrupt increase in toner depletion are sensed by the toner concentration monitor. The improved results are most evident when depletion rates change abruptly, as occurs when documents of widely varying average density are sequentially copied.

Figure 3A:
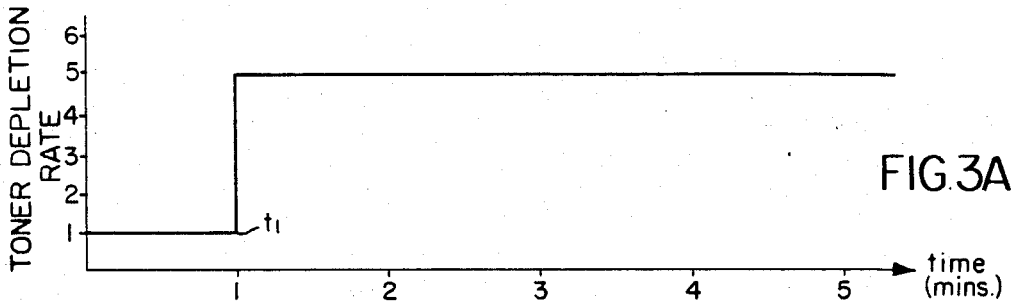
FIGS. 3A–3E show waveforms illustrating the relationship between toner depletion and replenishment.
Figure 3B:
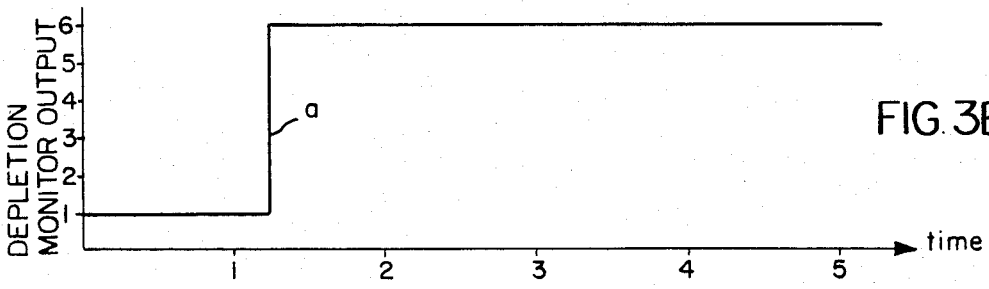
Figure 3C:
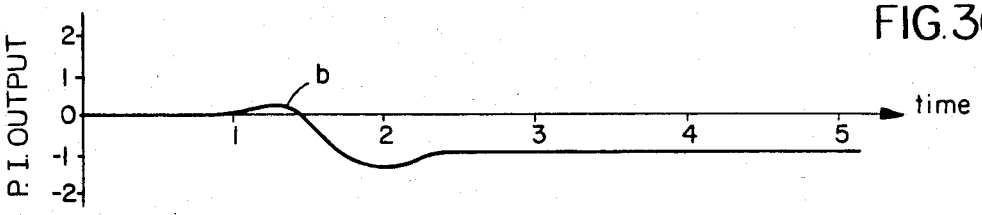
Figure 3D:
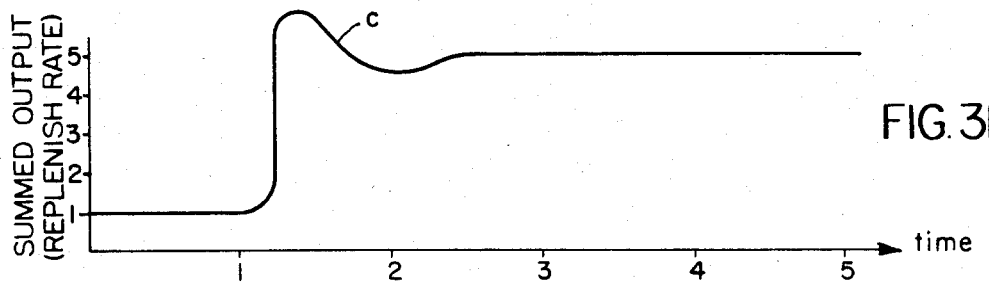
Figure 3E:
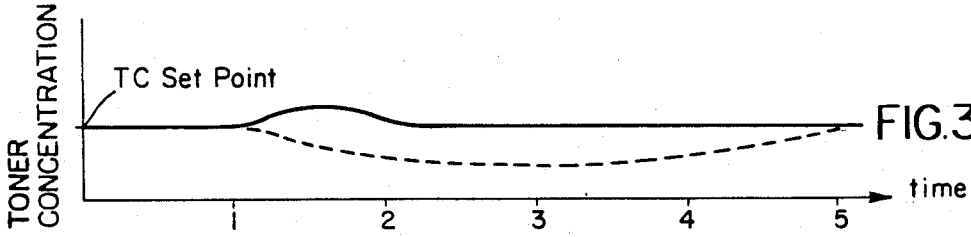

The major advantage of the invention may be better appreciated from the waveforms shown in FIGS. 3A–3E. In FIG. 3A, the toner depletion rate is shown to abruptly increase at time $t_1$. Shortly thereafter, the time depending on the distance between depletion monitor 42 and the development station and the rate of movement of the toner image, the increased toner depletion rate is reflected in the output a of toner depletion monitor 42. This is shown in FIG. 3B. For the reasons noted above, the output of monitor 42 is typically an imprecise measure of the actual toner depletion and, in the illustration, the depletion monitor is shown to produce a replenishment signal which would, by it self, cause over replenishment. Nevertheless, this signal is used, in accordance with the present invention, to initiate the toner replenishment process long before the toner concentration monitor 30 even detects the shortage. In response to the abrupt increases in toner depletion, the PI output b, as shown in FIG. 3C, will initially increase slightly, shortly thereafter however, the effect of the slightly excessive replenishment due to the toner depletion monitor will be reflected in the increased toner concentration monitor output which will cause the PI output to drop substantially below its initial steady-state level. Toner concentration (TC) then begins to fall toward the desired level, and the PI output begins to rise to a new steady-state level which is somewhat lower than its initial level to compensate for the tendency (in this case) for the toner depletion signal alone to over-replenish. The algebraic sum of signals a and b is shown in FIG. 3D as waveform c. It is this signal which is used to control the toner replenishment motor. The perturbation caused in toner concentration by the step function shown in FIG. 3A is shown in FIG. 3E. By way of comparison, the waveform shown in phantom lines in FIG. 3E illustrates the manner in which toner concentration would vary without using the toner depletion monitor's signal to augment the toner concentration monitor's signal. It will be appreciated that the replenishment control apparatus of the invention causes the toner concentration to return to its ideal level at a much faster rate, with smaller deviations from the desired toner concentration level.

The invention has been described in detail with particular reference to preferred embodiments; however it will be understood that variations and modifications can be effected without departing from the spirit and scope of the invention. For example, as an alternative to the optical-type depletion monitor described above, it is clear that other types of depletion monitors may be used, including the induction plate apparatus disclosed in the aforementioned Trachtenberg patent.

I claim:

1. In an electrographic reproduction apparatus comprising means for contacting an electrostatic image-bearing surface with a mixture of toner and carrier particles, such contact being effective to apply toner particles to such surface to render such electrostatic image visible, and means for replenishing such mixture with additional toner to compensate for toner depletion resulting from rendering such electrostatic charge visible, an improved toner replenishment control apparatus comprising:

(a) means for producing a first signal proportional to the level of concentration of toner in said mixture;

(b) means for producing a second signal proportional to the rate at which toner is applied to said surface in rendering such image visible;

(c) means for summing said first and second signals to produce a control signal; and (d) means responsive to said control signal for activating said replenishing means.

2. The apparatus as defined by claim 1 wherein said second-signal-producing means comprises means for optically monitoring the density of said visible image.

3. In an electrographic reproduction apparatus comprising means for contacting an electrostatic image-bearing surface with a mixture of toner and carrier particles, such contact being effective to apply toner particles to such surface to render such electrostatic image visible, and means for replenishing such mixture with additional toner to compensate for toner depletion resulting from rendering such electrostatic charge visible, an improved toner replenishment control apparatus comprising:

(a) means for sensing the concentration level of toner in said mixture and for producing a first signal representative thereof;

(b) means for comparing said first signal with a reference signal representative of a desired concentration level and for producing an error signal representing the difference between said first signal and said reference signal;

(c) means for integrating said error signal to produce an integrated error signal;

(d) means for producing a second signal proportional to the rate at which toner is applied to said surface in rendering such image visible;

(e) means for summing said second signal with said integrated error signal to produce a control signal; and (f) means responsive to said control signal for activating said replenishing means.

4. The apparatus as defined by claim 3 wherein said second-signal-producing means comprises means for optically monitoring the density of said visible image.

* * * * *